United States Patent [19]

Lienhard

[11] 4,125,174

[45] Nov. 14, 1978

[54] SCAFFOLDING FOR USE IN A CONFINED AREA

[75] Inventor: Robert W. Lienhard, Pittsburgh, Pa.

[73] Assignee: Swiss Fabricating, Inc., Pittsburgh, Pa.

[21] Appl. No.: 816,040

[22] Filed: Jul. 15, 1977

[51] Int. Cl.[2] ..... E04G 1/06; E04G 1/12; E04G 1/36

[52] U.S. Cl. ..... 182/128; 182/178; 182/179; 182/229

[58] Field of Search ..... 182/128, 178, 179, 118, 182/229, 181; 61/41 A; 249/22

[56] References Cited

U.S. PATENT DOCUMENTS

| | | | |
|---|---|---|---|
| 1,213,043 | 1/1917 | Walker | 182/128 |
| 2,744,674 | 5/1956 | Smith | 182/189 |
| 3,245,188 | 4/1966 | Evans | 182/178 |
| 3,490,559 | 1/1970 | Torch | 182/229 |
| 4,015,395 | 4/1977 | Gostling | 182/178 |

FOREIGN PATENT DOCUMENTS

| | | | |
|---|---|---|---|
| 204,704 | 5/1966 | Sweden | 182/181 |

*Primary Examiner*—Reinaldo P. Machado
*Attorney, Agent, or Firm*—Robert D. Yeager

[57] ABSTRACT

Scaffolding, for working in an area having relatively close spaced sidewalls, comprising generally T-shaped stackable members wherein the top of the T is adjustable outward to contact the sidewalls and limit sideway scaffolding movement. The T-shaped members can be stacked vertically, one atop the other, to provide different heights. A work platform, or staging, extends between the top of the uppermost T-shaped section and the top of a similar height spaced apart T-shaped section. Horizontal supports or stabilizers extend between the vertical columns which are built up from the T-shaped sections. The T-shaped sections are formed from metal tubing with adjustable portions, such as a threaded member, being connected at the ends of the top tubular member. When the scaffolding is erected, these adjustable members are adjusted out to engage the walls between which the scaffolding is utilized. Guides are provided on the ends of the top tubular member to limit movement of the staging or work platform supported thereon. The bottom T-shaped member in each vertical column includes a base. The bottom of the other T-shaped members includes a stud which fits into the top of the next lower T-shaped member to provide a vertical support column. The horizontal stabilizers which extend between adjacent vertical columns include shaped connectors formed at each end thereof. The connectors are of a relatively snug fitting and limit movement of the vertical columns. The connectors are preferably formed from a square tubular member which is attached to the vertical column and a square stud which is attached to the horizontal member. The square stud connects into the square tubular member when the scaffolding is erected.

16 Claims, 9 Drawing Figures

SCAFFOLDING FOR USE IN A CONFINED AREA

BACKGROUND OF THE INVENTION

1. Field of the Invention

This invention relates to scaffolding and more particularly to a scaffolding which is usable in a confined area having relatively closely spaced sidewalls.

2. Description of the Prior Art

It is often necessary to work in confined areas having relatively closely spaced sidewalls. Examples of such confined areas are coke battery areas inside an oven where the fire walls must be repaired on replaced. A type of scaffolding used in present coke ovens consists of built up wooden sections. These present a fire and safety hazard in the confined areas where they are required. Another location where small width scaffolding is required is between support plates used inside of some large ships. The scaffolding is used between the plate supports in a ship to permit continuous welding of seams. A present method utilized in the ship uses support rods which are welded to the plates for supporting planks from which workmen can operate. These welded supports take time to form and must be removed before the ship is put in service.

It is desirable to have scaffolding for use in a confined area which can be quickly assembled and provides for various required work heights.

SUMMARY OF THE INVENTION

Scaffolding is disclosed for use in a location having relatively close spaced sidewalls. The scaffolding comprises a plurality of vertical columns extending upward between the sidewalls. The vertical columns are spaced apart and constructed to support a work platform or staging between tops thereof. The vertical columns are generally horizontally aligned within the confined work area. Means are provided on the vertical columns to limit movement of the vertical columns towards or away from the sidewalls. That is, sideway movement of the vertical columns is restricted. Horizontal stabilizers extend between the spaced apart vertical members to limit movement of the vertical members in the direction in which they are aligned.

Each vertical section consists of a base, a vertical member extending upward from the base, an adjustable member supported on the vertical member for engaging the sidewalls, and a top scaffolding support. A plurality of these vertical sections are spaced apart for supporting an elongated work platform. Stabilizers are provided between the vertical sections to provide additional rigidity for the scaffolding. The vertical members or columns can be formed from a plurality of stackable members.

Each vertical column is formed from stackable T-shaped sections. The bottom T-shaped section in each vertical column is connected to a base plate which rests on the bottom of the confined area between the sidewalls. The T-shaped sections are formed from tubing. The top of each T-shaped section is adjustable in length so that it can engage the sidewalls. The adjustable portion is formed at both ends of the tubular member. The adjustable portion can be an external threaded member which engages an internal threaded portion attached to the end of the tubular top member. The threaded rods can then be screwed out during installation until they engage the sidewalls.

The top of the vertical tube forming part of the T-shaped section is open and flush with the top horizontal tubular portions. Guides are attached to the ends of the top horizontal tubular portions between which staging can be positioned. The guides can be flat plates welded to the ends of the top tubular portion. The plates extend above the top tubular portion and act as guides or stops. A nut can be welded over an opening through the plate and into the top tubular portion. The nut can then engage the threaded rod portion.

All T-shaped sections other than the bottom section have a stud projecting from the bottom thereof. The stud is adapted to fit snugly within the open top in the vertical portion of the next lower T-shaped section. Thus, a plurality of T-shaped sections can be stacked one on top of the other to produce any desired height of confined space scaffolding. Since each T-shaped section includes an adjustable portion at the upper end thereof, the whole scaffolding is stabilized as the height increases.

Horizontal stabilizing members extend between adjacent spaced apart T-shaped sections. The horizontal stabilizing members are positioned beneath the top of the T-shaped member. These horizontal members are preferably joined to the T-shaped sections by a connector which provides for relatively little movement. Such a connector can be formed from male members, attached to the horizontal stabilizer, which snugly engage female members attached to the vertical portions of the T-shaped sections. When the T-shaped sections are assembled, they thus provide a relatively rigid scaffolding structure. The length of the horizontal stabilizing member can be selected to provide the desired number of vertical columns. By selecting a shorter horizontal stabilizing member, more vertical columns are required, providing for a stronger scaffolding.

The use of adjustable members at the top of the T-shaped sections permits the scaffolding to be used in areas wherein the sidewalls are irregular or tapering either from top to bottom or front to rear. The irregularities or tapers in the sidewalls are compensated for by the adjustable members attached to the top of the T-shaped sections.

it is an object of this invention to teach a scaffolding construction for use in a confined area which utilizes only a plurality of spaced apart aligned vertical members having adjustable portions for engaging the sidewalls to help maintain the scaffolding in position.

It is a further object of this invention to teach a scaffolding arrangement utilizing a plurality of vertical columns each of which is formed from stackable T-shaped sections wherein the length of the top of each T-shaped section is adjustable.

BRIEF DESCRIPTION OF THE DRAWINGS

For a better understanding of the invention, reference may be had to the preferred embodiments exemplary of the invention shown in the accompanying drawings in which.

DESCRIPTION OF THE PREFERRED EMBODIMENTS

Figure 1:
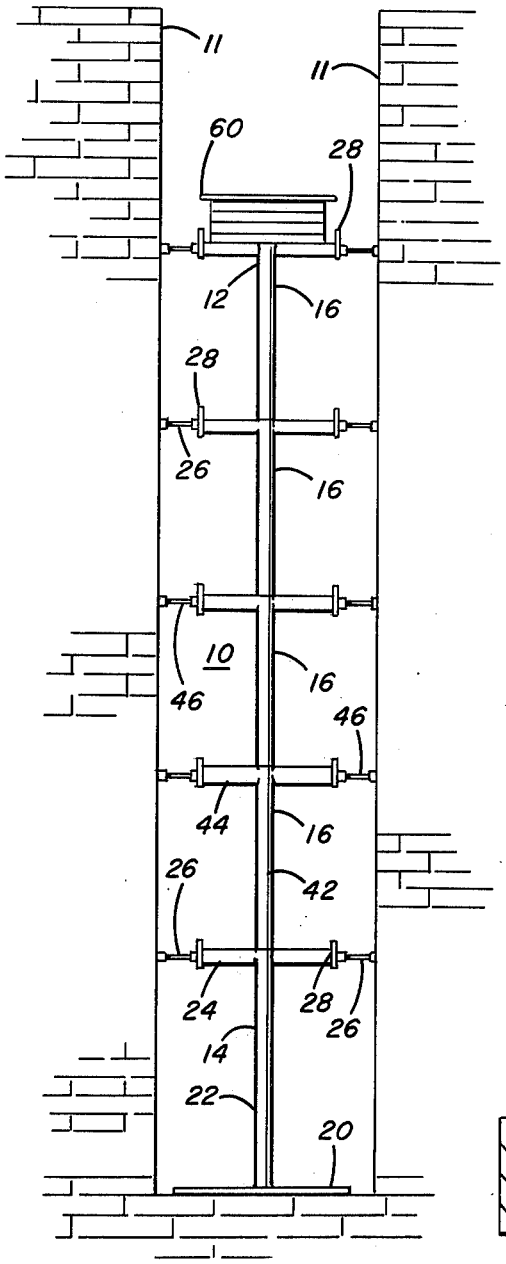
FIG. 1 is an end view of a scaffolding arrangement constructed according to the teaching of the present invention.

Referring now to the drawings, there is shown a scaffolding construction 10 which is particularly useful in an area having confining sidewalls 11. Scaffolding 10 consists of a plurality of vertical support columns 12 which are disposed within the confined area. The vertical columns 12 are spaced apart and generally horizontally aligned within the confined space.

Each vertical support column 12 consists of a base T-shaped member 14 and stacked T-shaped members 16. Disposed between the spaced apart T-shaped members 14 or 16, which form vertical columns 12, are fixed horizontal supports or stabilizers 18. These horizontal supports or stabilizers 18 help rigidize the assembled scaffolding and prevent movement of the scaffolding parallel to the sidewalls.

The length of the horizontal stabilizers can be selected to provide the desired number of vertical columns within the confined area. For a typical installation, the horizontal stabilizers are 10 feet long. If scaffolding 10 is required to support a greater load, the length of the horizontal stabilizer can be shortened, for example to 7 feet.

The bottom T-shaped section consists of a base plate 20, a vertical tubular member 22 extending upward from the base plate, and a top tubular portion 24. Top tubular portion 24 includes adjustable members 26 provided at each end thereof. When the scaffolding is installed, these adjustable members are positioned outward to engage sidewalls 11 and limit scaffolding movement. Guides or stops 28 are provided at the end of the tubular portion 24.

When a relatively low height is required, only the base T-shaped section 14 is used and a work platform or staging 30 can be supported from horizontal tubular portion 24. If greater scaffolding height is required, upper T-shaped sections 16 are added to the base T-shaped section 14. The top of each vertical tubular member 22 is open. The bottom of T-section 16 includes a stud 40 which fits within the opening of the next lower T-shaped section. T-shaped section 16 consists of a vertical portion 42, a top horizontal portion 44 and adjustable members 46 extending from both ends of top portion 44. When the T-shaped sections are assembled, the vertical portions 14 and 16, in each vertical column 12, are aligned. The tops of vertical sections 22, 42 are open to receive, if necessary, the aligning stud 40 from the next higher T-shaped section 16.

Figure 6:
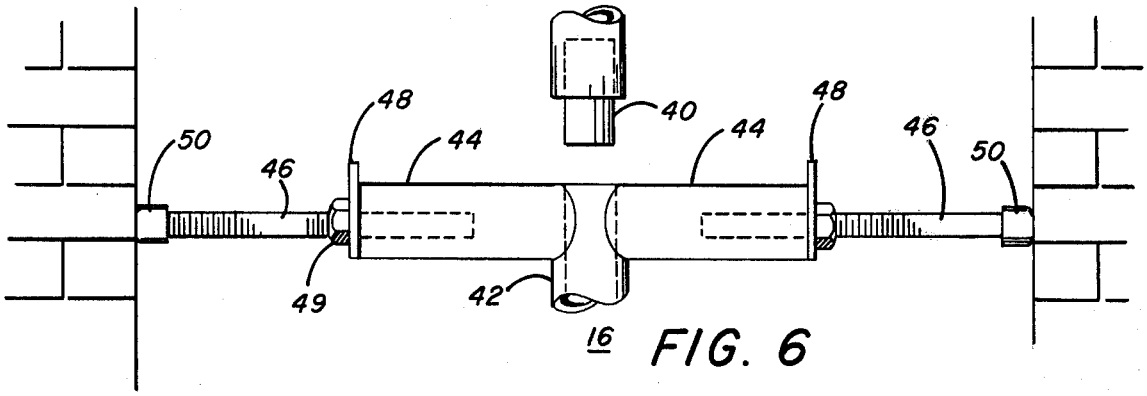
FIG. 6 is an enlarged detail at the top of a T-section.
Figure 5:
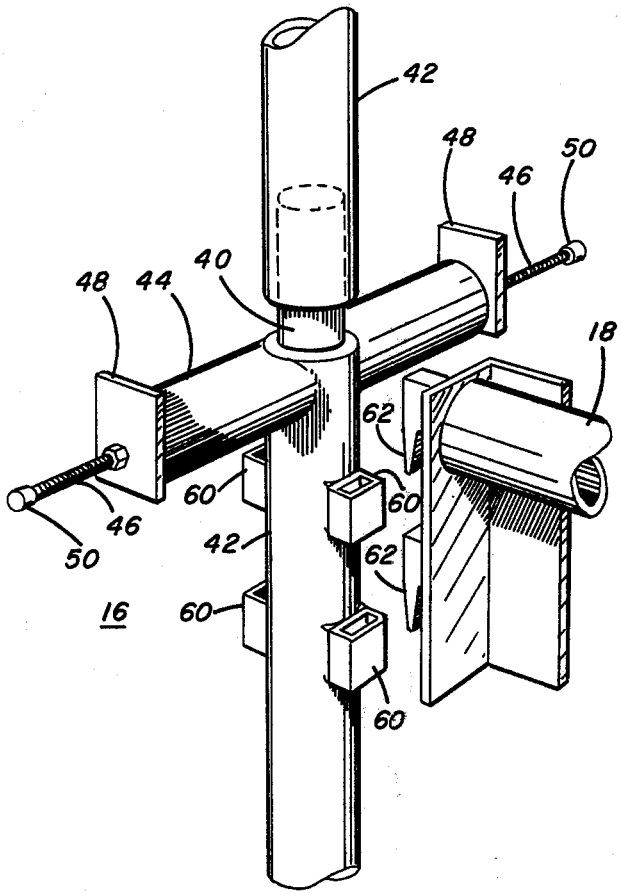
FIG. 5 is a detailed view of a typical T-section.

Referring now to FIGS. 5 and 6, there is shown a more detailed view of the top of T-shaped section 16. The top of T-shaped section 14 is similar in construction to T-shaped section 16 and the same explanation can be applied thereto. Horizontal tubular portion 44 extends from the top of vertical portion 42. The open end of vertical tubular member 42 is flush with the topmost portion of horizontal tubular portion 44. Guides or stops 48 are provided on the outside end of tubular portion 44.

Staging 30 can be supported on tubular member 44 between guides 48. Plates 48 include a nut 49 welded over an opening therethrough. A threaded rod member 46 is positioned partially within each horizontal member 44, in engagement with nut 49. Threaded rod portions 46 include ends 50 which are adapted to engage sidewalls 11 when scaffolding 10 is installed. Threaded members 46 are adapted to be screwed within horizontal tubular member 44 to change the distance between support tips 50.

For a typical sized scaffolding 10, with the screw members 46 screwed fully in, the scaffolding 10 can fit within an area having a wall separation of 2 feet and with the screw members 46 fully extended, scaffolding 10 can fit within a confined area having a wall spacing of 3½ feet. By strengthening the horizontal portions 44, such as by bracing, the distance between the sidewalls, where scaffolding 10 is usable, can be increased.

Figure 7:
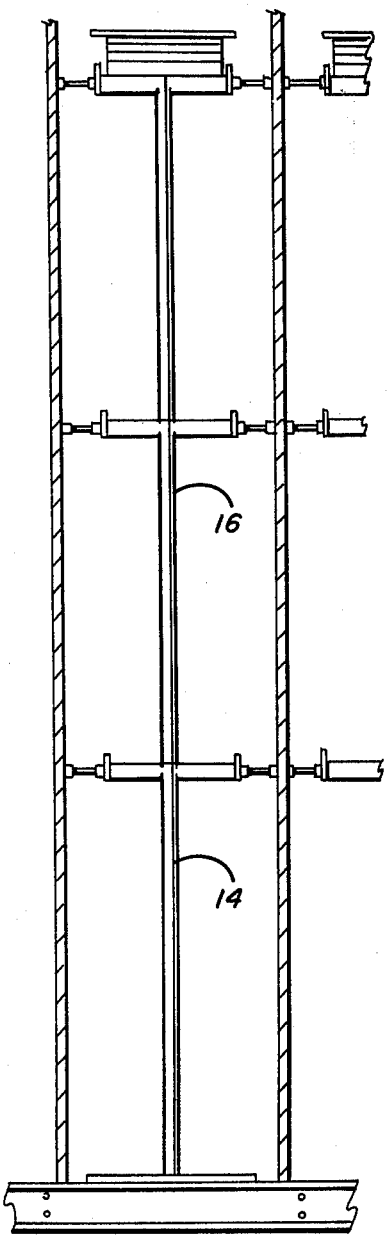
FIG. 7 is a view of the scaffolding utilized between reinforcing plates in a ship.

Depending on the work being performed, the height of vertical portions 22, 42 can be varied to suit. For example, as shown in FIG. 7, for scaffolding 10 within a ship, the scaffolding 10 can be built up from T-shaped sections having a height of 6½ feet. This separation permits an operator to easily weld a seam for that length. For operations within a coke oven wherein brick laying may be required, the separation between the top of stacked T-shaped members can be kept smaller, such as to 3 feet.

Depending on the particular job, the scaffolding 10 can be either built up or taken down as the job progresses. For example, for a brick laying job, the work would progress from the bottom up to some maximum height. In this instance, scaffolding sections would be added as required. While in ship construction, it might be desirable to weld from the top down. This would require removal of scaffolding sections as the work progressed.

Figure 8:
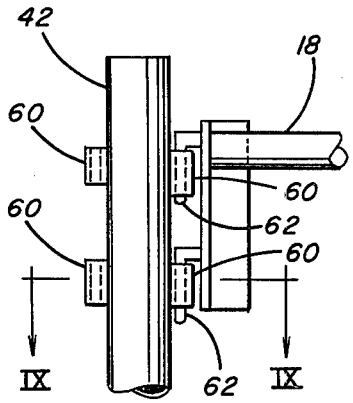
FIG. 8 is a side view of the end portion of the horizontal stabilizers connection to a vertical column; and, FIG. 9 is an enlarged section view along line IX—IX of FIG. 8.
Figure 9:
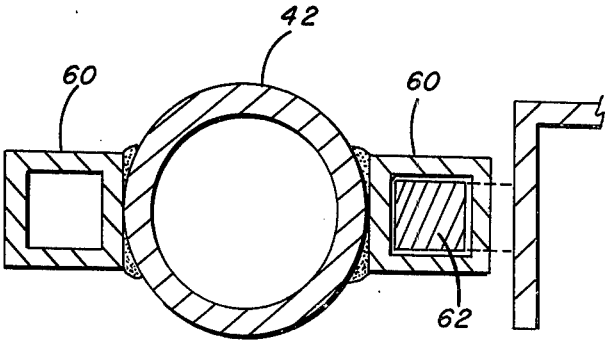

As shown in detail in FIGS. 8 and 9, each vertical member 22, 42 has square tubular members 60 welded thereto. Mating square studs 62 are secured to horizontal stabilizer 18. When the scaffolding 10 is assembled, each square tubular member 60 is engaged by a square stud 62 secured to the ends of horizontal member 18. Horizontal members 18 serve mainly to stabilize the scaffolding structure. The close tolerance connectors formed by square tubular member 60 and square studs 62 limit movement of the assembled scaffolding in a direction parallel to the walls.

Figure 2:
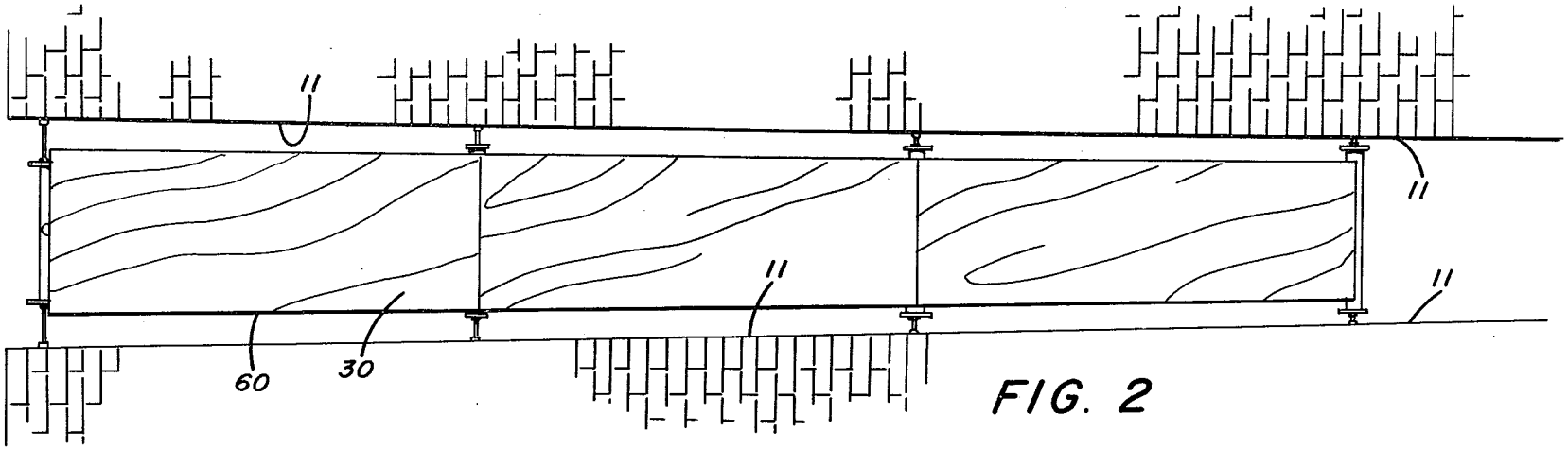
FIG. 2 is a plan view of the scaffolding arrangement shown in FIG. 1.
Figure 4:
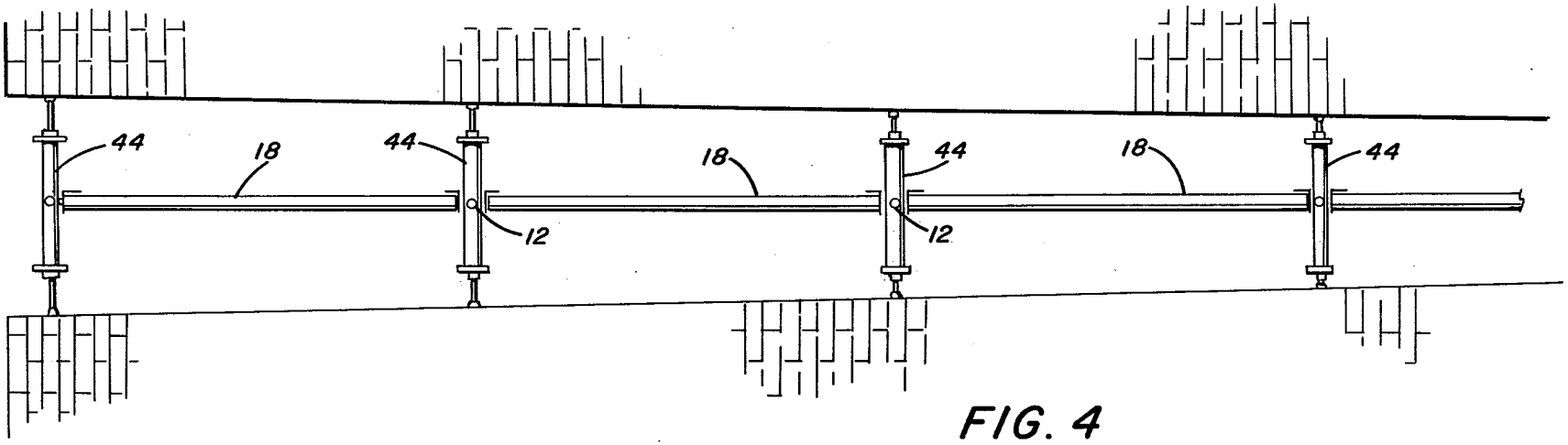
FIG. 4 is a section view of the scaffolding shown in FIG. 3 along the lines IV—IV.
Figure 3:
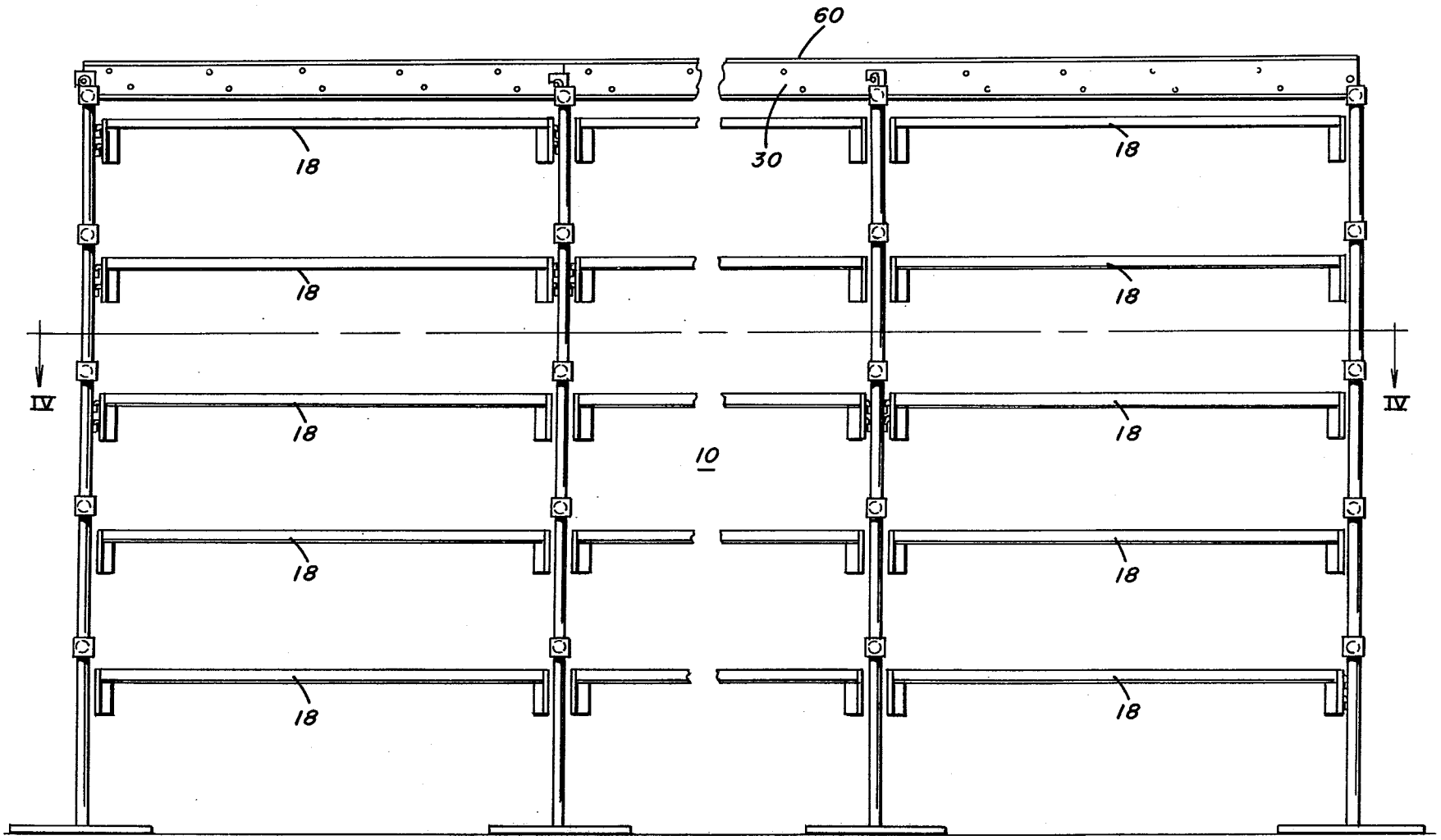
FIG. 3 is a side view of the scaffolding arrangement shown in FIG. 1.

As shown in FIGS. 2 and 4, scaffolding can be used within an area where the walls 11 are tapered or of an irregular shape. This tapering of the walls can be taken up for by different lengths of adjustment screw members 26, 46. While the bottom of the staging or work platform 30 is confined to the area between the stops 48 on the ends of horizontal tubular members 22, 44, the top wooden portions 60 can be extended as close as desired to sidewalls 11. The disclosed scaffolding is easy to assemble and requires no bolted connections. The disclosed scaffolding is formed of metal and eliminates a fire hazard which can be caused by the use of wooden scaffolding in a confined area. Further, by changing the various scaffolding parameters, scaffolding can be provided for a wide variety of height and spacing requirements.

What is claimed is:

1. A scaffolding for use in an area having relatively closely spaced sidewalls comprising:

at least a pair of vertical members disposed between the sidewalls;

a first horizontal member connected to each vertical member; and, horizontal adjusting means formed with each horizontal member for extending out from each horizontal member to engage the sidewalls and prevent movement towards or away from the sidewalls by the supported scaffolding.

2. Scaffolding as claimed in claim 1 wherein:

said horizontal member is hollow; and, said horizontal adjusting means comprises a screw member positioned in each end of said horizontal member for movement between a retracted position within said horizontal member and an extended position projecting from said horizontal member.

3. Scaffolding as claimed in claim 1 comprising:

a base for each vertical member; and a second horizontal member extended between adjacent pairs of vertical members.

4. Scaffolding as claimed in claim 3 comprising:

connecting means for connecting said second horizontal member to said vertical member; and, said connecting means comprising a square tubular member attached to said vertical member and a square stud attached to said second horizontal member.

5. Scaffolding as claimed in claim 1 comprising:

said first horizontal member is connected to the top of said vertical member;

staging extending between the tops of said vertical member and said first horizontal member; and, guides extending upward from the said first horizontal member to limit movement of said staging.

6. Scaffolding for supporting a work platform in a location having relatively close spaced sidewalls comprising:

a plurality of vertical members, disposed between the sidewalls, extending upward;

an elongated horizontal adjustable member attached intermediate its ends to each vertical member and being adjustable in length to extend between the sidewalls; and, staging supported by some of said horizontal members and extending between the tops of said plurality of vertical members and said associated horizontal adjustable member to provide the work platform.

7. Scaffolding as claimed in claim 6 comprising:

a base member for supporting each vertical member;

a horizontal member extending between adjacent vertical members to limit movement of the scaffolding parallel to the sidewalls; and, connecting means for connecting said horizontal members to said vertical members.

8. Scaffolding as claimed in claim 7 wherein said connecting means comprises:

a formed tubular member connected to said vertical member and a formed stud, having the same general shape as said formed tubular member, connected to said horizontal member for engaging said formed tubular member when the scaffolding is assembled.

9. Scaffolding as claimed in claim 6 wherein said elongated horizontal adjustable member comprises:

a tubular portion having said vertical portion connected intermediate the ends thereof;

a screw member connected to each end of said tubular portion being adjustable between an extended position and a retracted position.

10. Scaffolding as claimed in claim 9 comprising:

guides extending upward from the ends of said tubular portions.

11. Scaffolding for use between close spaced sidewalls comprising:

a plurality of horizontally aligned vertical columns;

a plurality of horizontal stabilizers extending between said plurality of vertical columns; and, a plurality of horizontal support members formed integral with the top of each of said plurality of vertical columns and having the vertical columns joined thereto intermediate the ends thereof and extending in a direction perpendicular to said vertical member and perpendicular to said horizontal stabilizer and being adjustable to a position in engagement with the sidewalls to prevent movement perpendicular to the sidewalls.

12. Scaffolding as claimed in claim 11 wherein each vertical column comprises:

a plurality of vertical members which are joined together;

a horizontal member extending from the top of each of said vertical members and being adjustable to engage the sidewalls; and, a base, disposed between the sidewalls, secured to the bottom vertical member for supporting the bottom vertical member.

13. Scaffolding comprising:

a plurality of T-shaped sections;

said T-shaped sections comprising a top portion which is adjustable in length;

said T-shaped sections being stackable to provide different heights; and, staging supported by the uppermost T-shaped section.

14. Scaffolding supported from a floor for use in a location having closely spaced walls comprising:

a plurality of flat bases each supported from the floor;

a plurality of vertical columns each connected to and extending upward from one of said bases;

adjustable horizontal members each connected intermediate its ends to one of said vertical columns and being capable of outward adjustment to contact the closely spaced walls; and, a top portion formed at the top of each of said plurality of vertical columns constructed to support a work platform between the closely spaced walls.

15. Scaffolding as claimed in claim 14 comprising:

horizontal stabilizers connected between said plurality of vertical columns for limiting movement of the scaffolding in a direction generally parallel to the closely spaced walls;

connector means provided for connecting the ends of said horizontal stabilizers to spaced apart vertical columns; and, said connector means comprises square tubular members connected to said vertical columns and mating square stud members connected to the ends of the horizontal stabilizers.

16. Scaffolding as claimed in claim 15 wherein:

each of said vertical columns is formed from a plurality of stacked members.

* * * * *